US008757954B1

(12) United States Patent
Roy

(10) Patent No.: US 8,757,954 B1
(45) Date of Patent: Jun. 24, 2014

(54) MARITIME TRANSFER SYSTEM

(71) Applicant: J. Edwin Roy, Lafayette, LA (US)

(72) Inventor: J. Edwin Roy, Lafayette, LA (US)

( * ) Notice: Subject to any disclaimer, the term of this patent is extended or adjusted under 35 U.S.C. 154(b) by 0 days.

(21) Appl. No.: 14/017,158

(22) Filed: Sep. 3, 2013

(51) Int. Cl.
*B65G 67/60* (2006.01)
*B63B 27/00* (2006.01)

(52) U.S. Cl.
USPC ..... 414/139.5; 114/368; 187/298; 182/142; 414/137.5

(58) Field of Classification Search
USPC ..... 414/137.5, 139.5, 142.8; 187/210, 224, 187/226, 262, 272, 289, 290, 298; 114/366, 114/368, 377, 348, 349, 355, 362–363, 114/365; 182/142, 145, 150
See application file for complete search history.

(56) References Cited

U.S. PATENT DOCUMENTS

| | | | | | |
|---|---|---|---|---|---|
| 2,874,855 | A | | 2/1959 | Rees, Jr. | |
| 2,876,919 | A | | 3/1959 | True et al. | |
| 2,963,179 | A | | 12/1960 | Kanady et al. | |
| 2,986,750 | A | * | 6/1961 | Herreshoff | 114/368 |
| 2,998,148 | A | | 8/1961 | Himel, Jr. | |
| 3,064,829 | A | | 11/1962 | Winfrey et al. | |
| 3,463,271 | A | * | 8/1969 | St. Louis | 187/259 |
| 3,476,263 | A | * | 11/1969 | Ujihara et al. | 212/274 |
| 3,512,657 | A | * | 5/1970 | Chambers | 414/138.3 |
| 3,804,268 | A | * | 4/1974 | Barron et al. | 414/139.5 |
| 4,180,362 | A | | 12/1979 | Stair | |
| 4,257,493 | A | * | 3/1981 | Beckham | 187/262 |
| 4,348,960 | A | | 9/1982 | Staurseth | |
| 4,412,598 | A | | 11/1983 | Kimon et al. | |
| 4,635,802 | A | * | 1/1987 | Hylton | 212/285 |
| 4,666,357 | A | | 5/1987 | Babbi | |
| 4,718,564 | A | * | 1/1988 | Bailey | 212/179 |
| 4,858,775 | A | * | 8/1989 | Crouch | 212/312 |
| 5,445,094 | A | * | 8/1995 | Kai et al. | 114/65 R |
| 5,713,710 | A | | 2/1998 | Strong et al. | |
| 5,909,817 | A | * | 6/1999 | Wallace et al. | 212/275 |
| 6,640,934 | B1 | * | 11/2003 | Edwards | 187/239 |
| 6,666,299 | B2 | * | 12/2003 | Cole | 182/145 |
| 6,681,894 | B1 | * | 1/2004 | Fanguy | 182/113 |
| 7,021,427 | B2 | * | 4/2006 | Skovgaard et al. | 187/281 |
| 7,252,315 | B2 | | 8/2007 | Liberato et al. | |
| 2004/0217611 | A1 | | 11/2004 | Liberato et al. | |
| 2005/0006175 | A1 | * | 1/2005 | Overby et al. | 182/142 |
| 2008/0087497 | A1 | * | 4/2008 | Boswell et al. | 182/142 |
| 2008/0223278 | A1 | * | 9/2008 | Carro Donna et al. | 114/264 |
| 2010/0252365 | A1 | | 10/2010 | Feller et al. | |

FOREIGN PATENT DOCUMENTS

| | | |
|---|---|---|
| GB | 2136037 | 9/1984 |

* cited by examiner

*Primary Examiner* — Gregory Adams
*Assistant Examiner* — Lynn Schwenning
(74) *Attorney, Agent, or Firm* — Richard C Litman

(57) ABSTRACT

The maritime transfer system is for crewmember safety when transferring to and from a vessel to a small oil or gas production platform that otherwise has only a swing rope for transfer. The system includes a platform extension permanently affixed to the platform, and a motor and winch installed on the extension. The motor and winch operate a cable that extends to a davit, the davit and cable suspending a car or gondola therefrom. Control is provided by a remote control switch installed on the distal end of a freely suspended control cable. In this manner, the car may be raised to the platform when not in use, the control hanging from the control cable for access from the crew vessel when needed. The crewmember may then carry the control with him or her in the car as it is raised and lowered to and from the platform.

1 Claim, 2 Drawing Sheets

MARITIME TRANSFER SYSTEM

BACKGROUND OF THE INVENTION

1. Field of the Invention

The present invention relates generally to hoists, lifts, and the like, and particularly to a maritime transfer system for transferring personnel and/or equipment to and from a crew boat or vessel and an offshore gas or oil production platform.

2. Description of the Related Art

Offshore or maritime oil and gas drilling and production platforms have expanded nearly worldwide, as oil and gas deposits have been discovered beneath the sea floor in most areas of the world. The construction and maintenance of these platforms have necessitated the transfer of crews and equipment back and forth from land bases to the offshore platforms. This transfer process can be relatively complex, since travel must be accomplished from a stable land base to a platform at sea, and the platform is generally elevated at some distance above the water level.

Larger platforms used for drilling are generally sufficiently large as to require a full time crew and are usually equipped with a helicopter landing pad for the transfer of crews and certain equipment. These large platforms may have some means of accommodating supply boats and ships as well, and additional accommodations to facilitate the physical transfer of personnel to and from the supply boat or ship.

However, there are many quite small offshore platforms that are equipped only for oil or gas production. Many of these platforms have little more than a wellhead and a small surrounding platform, as they are completely automated and require only periodic visits by a crewman for maintenance or inspection, etc. These "normally unmanned installations" (NUT) are not typically of sufficient size to accommodate a helicopter, so that crew members are delivered to and from the site only by a relatively small crew supply boat. As a result, the means for transferring from the boat to the platform and back to the boat is generally primitive, at best. The general means of transfer is by a single rope. The crewman grabs a rope suspended from the platform and swings from the boat to the platform. Clearly, this is potentially hazardous due to motion of the boat relative to the fixed platform from wave action, wind, and/or other forces. There have been instances of serious injury to crewmembers when the crew boat was pushed against the platform structure, where no more than a swing rope was provided for transfer.

Thus, a maritime transfer system solving the aforementioned problems is desired.

SUMMARY OF THE INVENTION

The maritime transfer system provides an economical and easily retrofitted assembly to facilitate the safe transfer of personnel and/or equipment to a small oil or gas production platform from a supply or crew boat, or other vessel. The transfer system includes a platform extension that is added (e.g., welded, bolted, etc.) to the existing platform. Nearly all necessary transfer equipment is located on the extension. The extension serves to position all electrical equipment at a predetermined distance (e.g., ten feet) from the wellhead on the platform in order to comply with regulations.

A prime mover, preferably an electric motor and winch, are installed on the extension. The winch controls a cable used to lift and lower a car or gondola. An overhead davit extends outward from the platform and beyond the extension. The cable runs up to the davit to support the car therefrom. Preferably, the cable passes through a double pulley and sheave assembly above the car, the lateral spacing of the pulleys providing additional stability for the car. Solar cells are provided to charge an electrical storage battery or batteries during periods of non-use of the system.

Control of the motor is provided by a remote switch that is connected to the free end of a flexible cable extending from the motor assembly. The control switch is not physically secured to any of the structure, other than to the distal or free end of the control cable. This permits the control switch to be positioned within or outside of the car, as required. Normally, the car is raised to the level of the platform when the platform is unattended in order to lift it clear of wave action and potential damage. However, the control switch is left hanging from its cable, only a short distance above the water level.

When personnel need to transfer to the platform, the crewmember may easily reach the hanging control switch from the boat or vessel to lower the car. When the car has been lowered to the boat, the crewmember can climb into the car while carrying the control with him or her into the car. The crewmember then uses the control to lift the car to the level of the platform, or more particularly, to the platform extension. The operation is reversed when the crewmember departs the platform. In this manner only a single switch box is required to carry out all control operations, rather than requiring multiple interrelated switches in parallel and installed in various locations.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The maritime transfer system provides a quickly installed and economical means for greatly increasing the safety of workers visiting smaller offshore oil and gas production platforms that are otherwise ordinarily equipped with only a swing rope for access. Such smaller production platforms generally have only a wellhead installed thereon, and do not have the size or facilities for a helicopter landing pad or for conveniently mooring a boat or other vessel thereto. The maritime transfer system greatly reduces, if not eliminates, the chance of injury to a crewmember during the process of transferring from a crew boat or supply vessel to the platform, and from the platform back to the boat or vessel.

Figure 1:
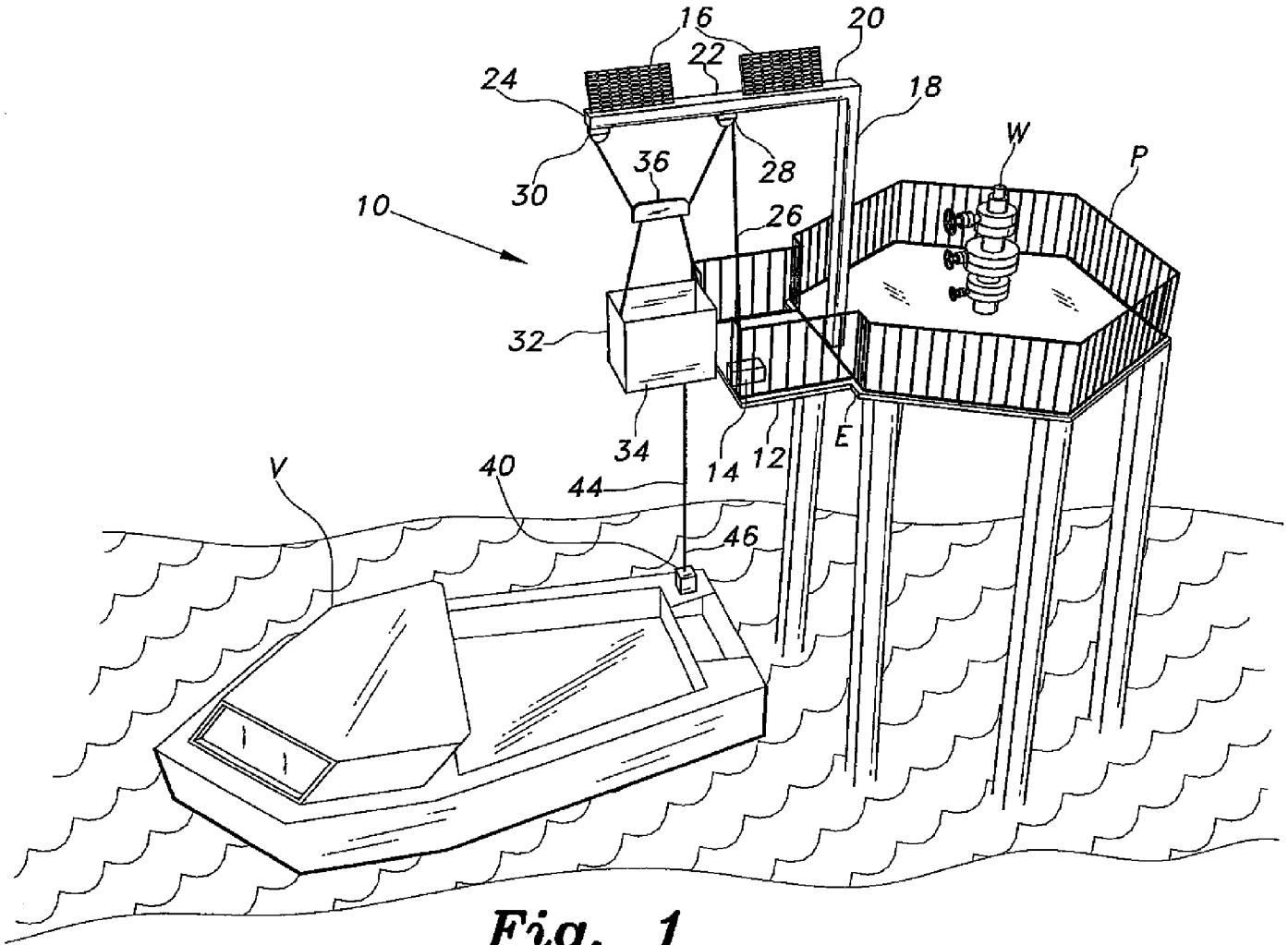
FIG. 1 is an environmental, perspective view of a maritime transfer system according to the present invention, as installed on a gas or oil production platform.
Figure 2:
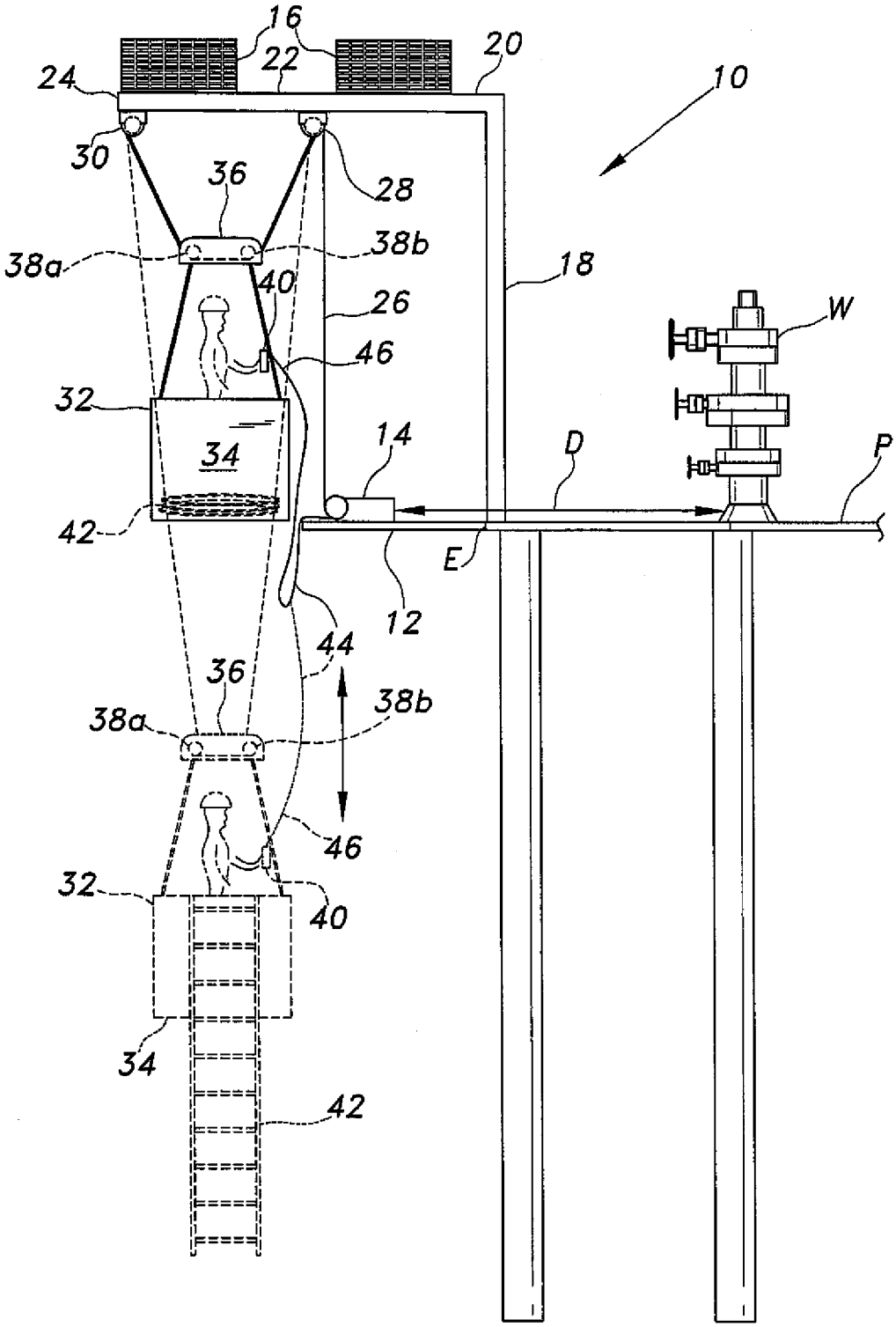
FIG. 2 is a side elevation view of the maritime transfer system as installed on a gas or oil production platform, illustrating additional features thereof.

FIG. 1 of the drawings provides an environmental perspective view of an exemplary transfer system 10, wherein a crew boat or supply vessel V is stationed at the production platform P. FIG. 2 is a side elevation view of the production platform P with the maritime transfer system 10 extending therefrom. It should be noted that the safety rail about the perimeter of the platform P and transfer system is not shown in FIG. 2 for clarity in the drawing. The maritime transfer system 10 includes a platform extension 12 that is permanently affixed (e.g., welded, bolted, etc.) to the periphery or outer edge E of the platform P, preferably coplanar therewith.

A motorized winch and electrical storage battery assembly 14 is installed on the platform extension 12 to provide power for cable actuation, as explained further below. The winch may be powered by any suitable prime mover, but is preferably powered by an electric motor in combination therewith. The battery may be a conventional electrical storage battery (e.g., gel cell, or other suitable type), which receives power for recharging from one or more photovoltaic panels 16 installed at some suitable location with the transfer system 10 that communicate electrically with the battery in a conventional manner.

The motor, winch, and battery assembly 14 is preferably positioned near the outer edge of the platform extension 12, as shown in FIGS. 1 and 2, in order to separate them from the wellhead W by some distance D, as shown in FIG. 2 of the drawings. The platform extension 12 and the installation of the motorized winch and battery assembly 14 thereon place the maritime transfer system 10 in compliance with certain regulations for such equipment, which may require the equipment to be a certain minimum distance (e.g., ten feet) from the wellhead W.

A davit 18 is installed on the production platform P. The davit 18 has an elevated horizontal boom or arm 20 having a medial portion 22 extending over the platform extension 12 and a distal end 24 extending beyond the platform extension. The photovoltaic panels 16 may be installed along the boom 20 of the davit 18, or to some other suitable structure. A car suspension cable 26 extends from the winch assembly 14 up to and over a first or davit pulley 28 suspended beneath the medial portion 22 of the boom or arm 20. The distal end of the cable 26 is anchored or affixed to an attachment point 30 at the distal end 24 of the boom 20.

A crew and/or equipment transfer car or gondola 32 is suspended from the cable 26. The car 32 preferably comprises a rigid structure for protection of personnel therein while in use. At least the lower portion 34 of the car 32 is enclosed, although other car configurations may be used. The superstructure of the car 32 includes a double pulley bracket or housing 36 having laterally spaced first and second pulleys 38*a* and 38*b* (shown in broken lines in FIG. 2) installed therein. The double pulley housing 36 provides additional stability for the car 32, reducing swaying of the car as it is suspended from the cable 26. The car suspension cable 26 extends downward from the davit pulley 28 to pass beneath the two pulleys 38*a* and 38*b* at the top of the car 32. Thus, as the winch assembly 14 draws the cable 26 in, the portion of the cable 26 extending from the davit boom 20 between the cable anchor point 30 and the davit pulley 28 is shortened, thereby lifting the car 32 upward. Paying out the cable 26 from the winch assembly 14 allows the portion of the cable 26 between the anchor point 30 and the davit pulley 28 to lengthen, thereby allowing the car 32 to descend.

Control of the lifting and lowering of the car 32 is accomplished by a control switch 40, which is housed in a weatherproof switch box. The control switch 40 is a conventional double-throw switch, enabling the motor of the winch assembly 14 to operate in one direction to draw the cable 26 in and raise the car 32, and to operate in the opposite direction to pay out the cable 26 to allow the car 32 to descend. Alternatively, other electrical switch arrangements may be used, e.g., two separate switches to operate the motor in opposite directions, etc. A conventional safety brake mechanism may be provided with the winch assembly 14. Additional safety may be provided by an emergency ladder 42 for deployment by personnel in the car 32 in the event of loss of power, e.g., a rope ladder or other suitably compact ladder or the like when folded. The emergency ladder 42 is shown in its stowed and folded configuration in broken lines in the floor of the car 32 of the upper position in FIG. 2, the ladder 42 being shown deployed in broken lines from the lower car position in FIG. 2. A freely suspended, flexible control switch cable 44 extends from the motorized winch assembly 14, the switch box and switch 40 being installed upon the free distal end 46 of the cable 44.

The platform P is normally unattended, as noted further above. In this situation, the car 32 is raised to a normally stowed position adjacent the platform extension 12, as shown in FIG. 1 and in solid lines in FIG. 2. However, the control switch 40 in its switch box is left suspended by the control switch cable 44, where it is accessible from a vessel V on the surface of the water, generally as shown in FIG. 1 of the drawings. When a vessel V delivers a crewmember to the production platform P, the crewmember takes the switch box and actuates the switch 40 to lower the car 32 to the level of the vessel V. The crewman then enters the car 32 and carries the switch box with him or her, enabling the crewmember to control the position of the car 32 at all times. The car 32 is raised to the level of the platform extension 12, allowing the crewmember to exit the car onto the extension and platform P to accomplish the desired inspection, maintenance, or other duties.

When the crewmember wishes to leave the platform P, he or she enters the car 23 from the platform extension 12 and uses the control switch 40 to lower the car 32 back to the level of the crew or supply vessel V. The crewmember exits the car 32 onto the vessel V, and retains the switch 40 on the end of its control cable 44 to raise the car 32 back to its normally stowed position at the level of the platform P and extension 12, where it is clear of the water surface and potentially damaging wave action or other effects.

It is to be understood that the present invention is not limited to the embodiments described above, but encompasses any and all embodiments within the scope of the following claims.

I claim:

1. A maritime transfer system, consisting of:

a petroleum production platform having a wellhead disposed thereon and a periphery disposed therearound;

a davit having an elevated horizontal boom, the boom having a medial portion and a distal end, the davit being disposed adjacent the periphery of the petroleum production platform;

a pulley depending from the medial portion of the boom;

a platform extension adjacent the davit, the platform extension extending laterally from the periphery of the petroleum production platform;

a car, wherein the car has a rigid structure having at least a lower enclosed portion;

a selectively deployable emergency ladder disposed within the car;

mutually laterally disposed first and second pulleys disposed above the car;

an electric winch assembly, the electric winch assembly including an electric winch;

at least one electrical storage battery communicating electrically with the electric winch; and at least one photovoltaic panel communicating electrically with the electrical storage battery;

a control switch cable extending from the electric winch, the control switch cable having a free distal end; and a control switch connected to the distal end of the control switch cable;

the electric winch assembly being disposed upon the platform extension; and a suspension cable extending from the electric winch assembly over the pulley of the medial portion of the boom and beneath the first and second pulleys above the car to the distal end of the boom.

* * * * *